US010739062B2

(12) United States Patent
Kuemmel et al.

(10) Patent No.: US 10,739,062 B2
(45) Date of Patent: Aug. 11, 2020

(54) REFRIGERATION APPLIANCE

(71) Applicant: BSH HAUSGERAETE GMBH, Munich (DE)

(72) Inventors: Roland Kuemmel, Nellingen (DE); Xiaofei Wu, Nanjing (CN); Ya Xu, Nanjing (CN); Chuan Zhang, Chuzhou (CN); Christian Schmid, Neu-Ulm (DE); Simon Kraemer, Aalen (DE); Andreas Feldmeyer, Lauchheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/376,167

(22) Filed: Apr. 5, 2019

(65) Prior Publication Data

US 2019/0310009 A1 Oct. 10, 2019

(30) Foreign Application Priority Data

Apr. 10, 2018 (CN) ..... 2018 1 0313572

(51) Int. Cl.
*F25D 23/06* (2006.01)
*F25D 29/00* (2006.01)
*F25D 25/02* (2006.01)

(52) U.S. Cl.
CPC ..... *F25D 23/061* (2013.01); *F25D 25/025* (2013.01); *F25D 29/005* (2013.01); *F25D 2400/40* (2013.01)

(58) Field of Classification Search
CPC .... F25D 23/021; F25D 23/028; F25D 23/061; F25D 23/065; F25D 23/067; F25D 23/08;
(Continued)

(56) References Cited

U.S. PATENT DOCUMENTS 3,156,019 A * 11/1964 Daniel ..... E06B 7/28 49/70
3,288,896 A * 11/1966 Mervin ..... F25D 23/082 264/46.5

(Continued)

FOREIGN PATENT DOCUMENTS

CN 1766508 A 5/2006
CN 106871529 A 6/2017

(Continued)

*Primary Examiner* — Andrew M Roersma
(74) *Attorney, Agent, or Firm* — Laurence A. Greenberg; Werner H. Stemer; Ralph E. Locher

(57) ABSTRACT

A refrigeration appliance includes a case body and a door to be connected to the case body for sliding forwards and backwards. The door includes a front wall, a rear wall spaced from the front wall, a side wall interconnecting the front and rear walls, and an accommodating space formed and enclosed by the front, rear the side walls and filled with a heat insulation material. A power and/or signal transmission apparatus passes through a through hole in the rear wall and includes cables. A cable guiding member located in the accommodating space is used for guiding the cables. Not only can the cables be fixed conveniently and prevented from being stacked randomly in the accommodating space, but the cable guiding member can also guide the cables and provide conditions for power supply for wiring in the door.

13 Claims, 4 Drawing Sheets

(58) Field of Classification Search
CPC ... F25D 25/025; F25D 29/005; F25D 2400/40
See application file for complete search history.

(56) References Cited

U.S. PATENT DOCUMENTS

| | | | | | |
|---|---|---|---|---|---|
| 5,248,196 | A * | 9/1993 | Lynn | F25D 23/065 | 264/276 |
| 7,836,720 | B2 * | 11/2010 | Cho | F25D 23/028 | 222/146.6 |
| 9,046,295 | B2 * | 6/2015 | Han | F25D 25/025 | |
| 2006/0207283 | A1 | 9/2006 | Kim et al. | | |
| 2017/0167779 | A1 * | 6/2017 | Haeberle | F25D 25/025 | |

FOREIGN PATENT DOCUMENTS

| | | | | | |
|---|---|---|---|---|---|
| DE | 29606772 | U1 | | 8/1996 | |
| DE | 102015216922 | A1 | * | 3/2017 | F25D 23/02 |
| JP | H-06294577 | A | * | 10/1994 | |
| JP | 2001263928 | A | * | 9/2001 | |
| JP | 2004076989 | A | * | 3/2004 | |
| JP | 2007113829 | A | * | 5/2007 | |
| KR | 100894478 | B1 | | 4/2009 | |
| KR | 20180021039 | A | | 2/2018 | |
| WO | WO-2008025647 | A1 | * | 3/2008 | F25D 23/065 |
| WO | WO-2009019268 | A2 | * | 2/2009 | F25D 23/068 |
| WO | WO-2010010031 | A1 | * | 1/2010 | F25D 23/065 |

* cited by examiner

REFRIGERATION APPLIANCE

CROSS-REFERENCE TO RELATED APPLICATION

This application claims the priority, under 35 U.S.C. § 119, of Chinese Patent Application CN 2018 1031 3572.3, filed Apr. 10, 2018; the prior application is herewith incorporated by reference in its entirety.

BACKGROUND OF THE INVENTION

Field of the Invention

The present invention relates to a refrigeration appliance.

Description of the Related Art

Chinese Patent Application CN 106871529 A discloses a refrigerator. The refrigerator includes a case body having a housing, a liner, a storage compartment defined in the liner, a door body disposed on a front surface of the case body to seal the storage compartment and a door body power supply unit, including a constraint groove, a slide rail bracket and a power supply cable. The constraint groove is disposed on an inner wall of the liner, the slide rail bracket is connected to the door body, one end of the power supply cable is drawn from the case body and disposed in the constraint groove and the other end comes out from the constraint groove and enters the door body through the sliding rail bracket, so that the power supply cable supplies power to the door body.

SUMMARY OF THE INVENTION

It is accordingly an object of the invention to provide an improved refrigeration appliance which overcomes the hereinafore-mentioned disadvantages and at least one technical problem of the heretofore-known devices of this general type.

With the forgoing and other objects in view there is provided, in accordance with the invention, a refrigeration appliance including a case body, a door capable of being connected to the case body in such a way as to slide forwards and backwards, the door including a front wall, a rear wall disposed apart from the front wall, a side wall that interconnects the front wall and the rear wall, and an accommodating space that is formed by encirclement of the front wall, the rear wall, and the side wall and is filled with a heat insulation material, and a power and/or signal transmission apparatus, the rear wall having a through hole for passing through the power and/or signal transmission apparatus, and the power and/or signal transmission apparatus including cables. The refrigeration appliance further includes a cable guiding member that is located in the accommodating space and used for guiding the cables. Located in the accommodating space in this respect means that the cable guiding member is either completely positioned within the accommodating space or at least parts of the cable guiding member or sections of the cable guiding member are positioned within the accommodating space and further parts or sections of the cable guiding member are positioned outside the accommodating space.

This structure is used to place the cable guiding member in the accommodating space. Thus, it is not only that the cables can be fixed conveniently and prevented from being stacked randomly or positioned randomly in the accommodating space, to save space and enhance a spatial utilization rate. In addition, the cable guiding member can guide the cable and can guide the cables in a better way especially when there are a lot of cables, so that the cables can pass through the cable guiding member conveniently. Therefore, the present invention provides conditions for a power supply for wiring in the door of the refrigeration appliance.

In addition, the cable guiding member is used to guide the cable, and the cables can be assembled conveniently, so that the assembly process is simple and operation is convenient.

According to an exemplary implementation of the present invention, the cable guiding member is fixed on the side wall or the front wall. Not only is the cable guiding member fixed conveniently, but the cables also pass through the cable guiding member conveniently.

According to an exemplary implementation of the present invention, the cable guiding member is connected to the rear wall. Therefore, the cable guiding member is connected to the rear wall, so that the cable guiding member is fixed stably in the accommodating space and prevented from wobbling during a foaming process.

According to an exemplary implementation of the present invention, the side wall is a bottom wall.

According to an exemplary implementation of the present invention, the cable guiding member has a guiding portion and the cables extend towards the front wall within the guiding portion. Thus, the cables pass through the guiding portion and extend towards the front wall.

According to an exemplary implementation of the present invention, the guiding portion extends out of the door through the through hole. The guiding portion extends out of the door, so that the guiding portion at least partially passes through the through hole. Therefore, the cables pass through the guiding portion, so that the cables pass through the through hole to extend out of the door and the cables extend out of the door from the accommodating space, so that the cables can be connected to an electrical component outside the door.

According to an exemplary implementation of the present invention, the guiding portion is in the shape of a slot or a hole. Therefore, the cables can pass through the guiding portion conveniently.

According to an exemplary implementation of the present invention, the refrigeration appliance further includes a fixing portion that is fixed on the side wall and the guiding portion that is used for guiding the cable, and the guiding portion is parallel with the fixing portion.

Thus, the cable guiding member is fixed on the side wall through the fixing portion and guides the cables through the guiding portion, so that the cables pass through the guiding portion. In addition, the guiding portion is parallel with the fixing portion, so that the cable guiding member has a compact structure, and the cable guiding member can be fixed and guide the cables conveniently.

According to an exemplary implementation of the present invention, the refrigeration appliance includes a support leg connected between the guiding portion and the fixing portion and the support leg obliquely extends towards the rear wall. Thus, the support leg is connected to the guiding portion and the fixing portion.

According to an exemplary implementation of the present invention, the refrigeration appliance further includes a fixing portion that is fixed on the front wall and the guiding portion that is used for guiding the cable, and the guiding portion is perpendicular with respect to the fixing portion. In this implementation, the cable guiding member has a compact structure and by being connected to the front wall and the rear wall, the cable guiding member is securely held. The fixing portion can in particular be parallel to the front wall. The fixing portion can be in the form of a closed frame. An outer diameter of the closed frame can be larger than an outer diameter of the guiding portion, further improving the stability of connection between the fixing portion and the front wall.

According to an exemplary implementation of the present invention, the cable guiding member includes a fixing portion for fixing the cable guiding member, the front wall or the side wall has a positioning structure matched with the fixing portion and the fixing portion is located in the positioning structure. The fixing portion and the positioning structure cooperate with each other to position the cable guiding member on the front wall or side wall in a better way, to prevent the cable guiding member from wobbling in a foaming process.

According to an exemplary implementation of the present invention, the power and/or signal transmission apparatus includes a wiring terminal, and the wiring terminal is located in the guiding portion and outside the door. Thus, the cables located in the door are electrically connected to a further power and/or signal transmission apparatus located outside the door such as a cable, a wiring terminal, and an electrical component through the wiring terminal.

According to an exemplary implementation of the present invention, the rear wall has a recess recessed away or apart from the accommodating space, and the cable guiding member is at least partially accommodated in the recess.

According to this structure, the cable guiding member is at least partially accommodated in the recess, thereby using a space efficiently, enhancing a spatial utilization rate, connecting the cable guiding member to the rear wall more compactly, and preventing the cable guiding member from wobbling badly in a foaming process.

According to an exemplary implementation of the present invention, the cable guiding member includes a protrusion extending upwards, and the protrusion is close to the recess in a vertical direction. Thus, a spacing between the protrusion and the recess in a vertical direction is small, and the cable guiding member is closer to the recess, to prevent the cable guiding member from wobbling in a better way in a foaming process.

According to an exemplary implementation of the present invention, the refrigeration appliance includes a guide rail connecting the case body and the door, the door is capable of sliding forwards and backwards along the guide rail, and the cables extend from the case body into the door along the guide rail. Thus, the cable passing through the case body can extend into the door, to realize electrical connection of electrical components in the case body and the door body.

According to an exemplary implementation of the present invention, the refrigeration appliance includes a power utilization component provided in the door. The power utilization component can be a display and/or control unit. The power utilization component can be light transmission unit.

According to an exemplary implementation of the present invention, the refrigeration appliance includes a power utilization component provided in the door, and the power utilization component is disposed on an end opposite to the cable guiding member.

According to an exemplary implementation of the present invention, the refrigeration appliance includes at least one further side wall. In particular, the refrigeration appliance includes three further side walls. The at least one further side wall may connect the front wall with the rear wall. The accommodating space may be encircled by the front wall, the rear wall, the side wall and the at least one further side wall.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

In order to make the objectives, structures, features, and functions of the present invention more comprehensive, the following embodiments are described in detail.

DETAILED DESCRIPTION OF THE INVENTION

Figure 1:
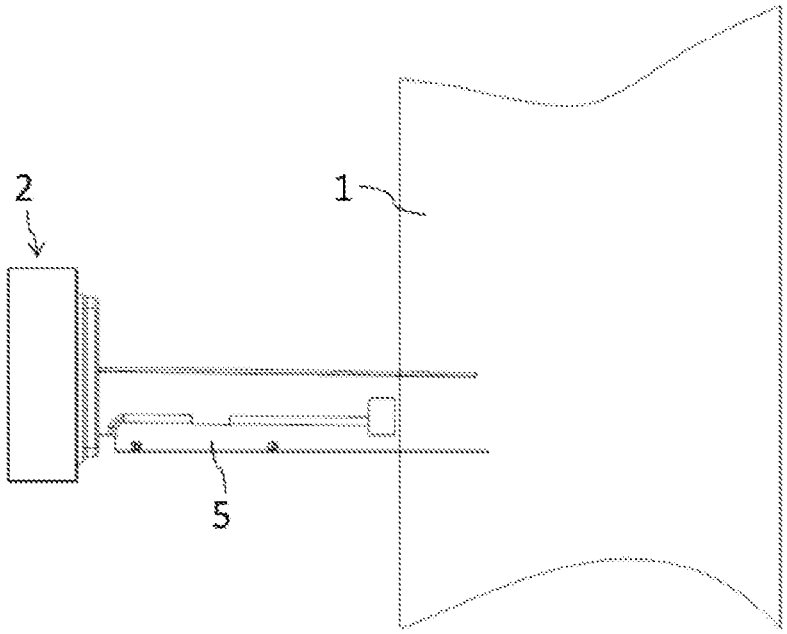
FIG. 1 is a fragmentary, diagrammatic, side-elevational view of a refrigeration appliance according to a preferred implementation of the present invention.

Referring now to the figures of the drawings in detail and first, particularly, to FIG. 1 thereof, there is seen a refrigeration appliance which includes a case body 1 and a door 2 capable of being connected to the case body 1 in a manner of sliding forwards and backwards. In an embodiment, the door 2 capable of being connected to the case body 1 in a manner of sliding forwards and backwards is a door 2 of a drawer.

The refrigeration appliance further includes a guide rail 5 connecting the case body 1 and the door 2, and the door 2 is capable of sliding forwards and backwards along the guide rail 5.

The refrigeration appliance further includes a power and/or signal transmission apparatus 3 configured to transmit electricity and/or signals. The power and/or signal transmission apparatus 3 includes cables and a connecting apparatus such as a wiring terminal.

Figure 2:
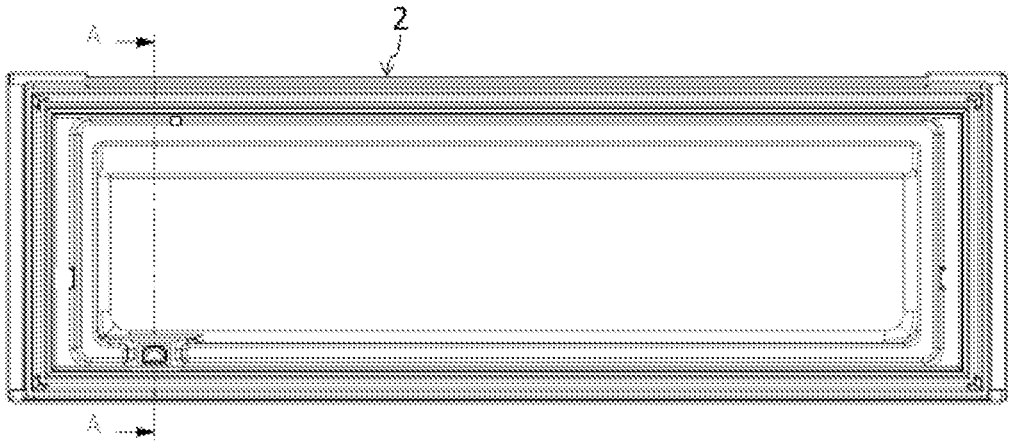
FIG. 2 is a plan view of a door according to a preferred implementation of the present invention.
Figure 3:
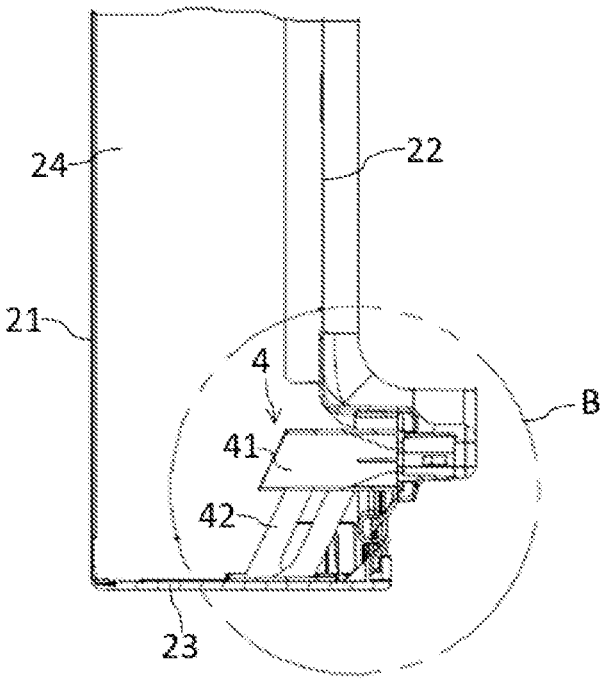
FIG. 3 is a fragmentary, cross-sectional view taken along the line A-A of FIG. 2 in the direction of the arrows.
Figure 4:
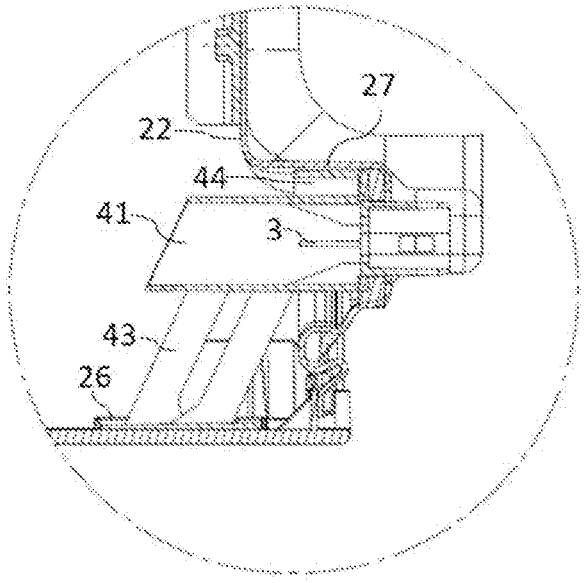
FIG. 4 is a fragmentary, enlarged view of the region B of FIG. 3.
Figure 5:
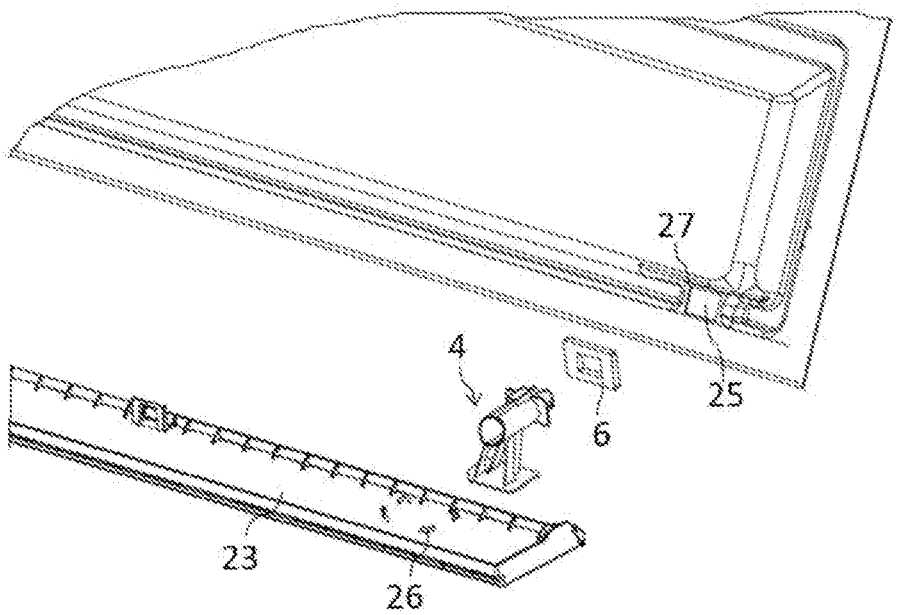
FIG. 5 is a fragmentary, exploded view of a door according to a preferred implementation of the present invention.
Figure 6:
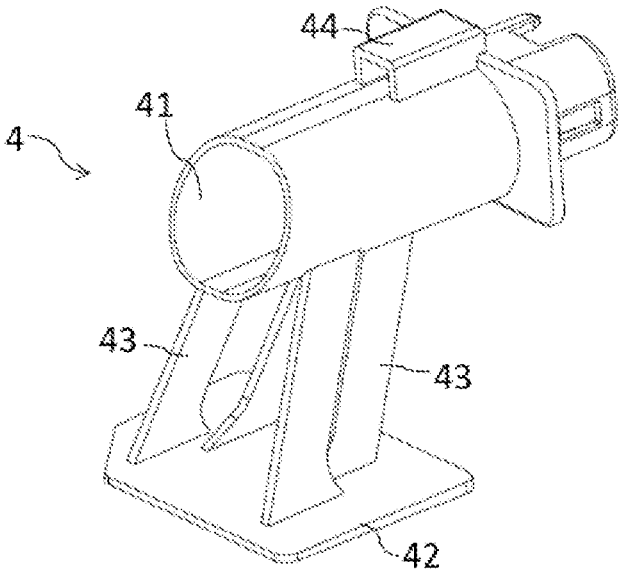
FIG. 6 is a perspective view of a cable guiding member according to a preferred implementation of the present invention.
Figure 7:
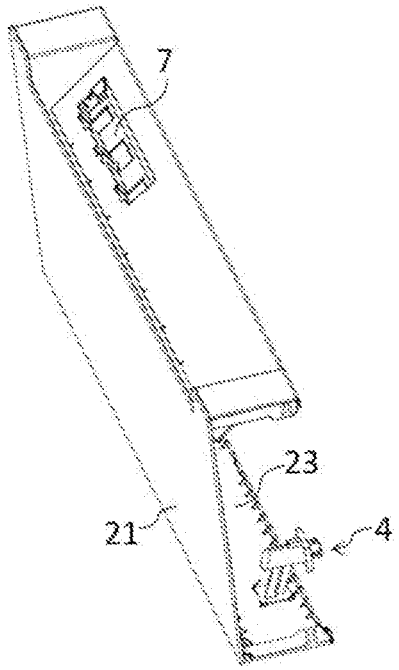
FIG. 7 is a perspective view of a door according to a preferred implementation of the present invention.

As shown in FIG. 2 and FIG. 3, the door 2 includes a front wall 21, a rear wall 22 that is disposed at intervals with the front wall 21, a side wall 23 that connects the front wall 21 and the rear wall 22, and an accommodating space 24 that is formed by encirclement of the front wall 21, the rear wall 22, and the side wall 23 and is filled with a heat insulation material.

In an embodiment, the side wall 23 is a bottom wall, and the front wall 21 and the rear wall 22 are respectively disposed at two sides of the side wall 23.

The rear wall 22 has a through hole 25, and the through hole 25 is in communication with the inside and outside of the door 2. In an embodiment, the through hole 25 is on an end of the rear wall 22 close to the side wall 23.

The power and/or signal transmission apparatus 3 can pass through the through hole 25, so that the power and/or signal transmission apparatus 3 outside the door 2 can pass through the through hole 25 to extend into the door 2.

The refrigeration appliance further includes a cable guiding member 4 located in the accommodating space 24 and used for guiding the cables. The cable guiding member 4 can not only fix the cables in the accommodating space 24, but also guide the cables and make the cables pass through the cable guiding member 4.

As shown in FIG. 3, the cable guiding member 4 is fixed on the side wall 23. In an alternative implementation, the cable guiding member 4 is fixed on the front wall 21.

The cable guiding member 4 further includes a sealing portion 6 disposed to surround a guiding portion 41 and the sealing portion 6 is used to seal the cable guiding member 4 and the rear wall 22. Thus, the sealing portion 6 seals a contact surface of the cable guiding member 4 and the rear wall 22, to avoid foam leakage at a connection position of the cable guiding member 4 and the side wall 23 in a foaming process and to prevent foam leakage from occurring in the foaming process.

The rear wall 22 has a recess 27 recessed away from the accommodating space 24 and the cable guiding member 4 is at least partially accommodated in the recess 27. In an embodiment, the recess 27 is on an end of the rear wall 22 close to the side wall 23. The cable guiding member 4 includes a protrusion 44 extending upwards and disposed close to the recess 27 in a vertical direction.

In a preferred implementation, the cable guiding member 4 is completely accommodated in the recess 27. Thus, the cable guiding member 4 will not protrude and extend out of the recess 27, and thus, the refrigeration appliance has a beautiful appearance, space is used efficiently, and a utilization rate of the accommodating space 24 is enhanced. Furthermore, the cable guiding member 4 may be prevented from wobbling badly in a better way during a foaming process and even if the cable guiding member 4 wobbles, it only wobbles in a small range of the recess 27.

The cable guiding member 4 includes a fixing portion 42 that is fixed on the side wall 23 and a guiding portion 41 that is used for guiding the cable, and the guiding portion 41 is parallel with the fixing portion 42.

The cable guiding member 4 further includes a support leg 43 connected between the guiding portion 41 and the fixing portion 42 and the support leg 43 obliquely extends towards the rear wall 22. The cable guiding member includes a plurality of support legs 43 distributed at two sides of the fixing portion 42. In an embodiment, the number of the support legs 43 located at two sides of the fixing portion 42 are the same.

The fixing portion 42 is configured to fix the cable guiding member 4 on the side wall 23 or the front wall 21. As shown in the figures, the side wall 23 or the front wall 21 has a positioning structure 26 matched with the fixing portion 42, and the fixing portion 42 is located in the positioning structure 26.

In an embodiment, as shown in the figures, the positioning structure 26 includes a plurality of positioning ribs and the positioning ribs extend upwards from the side wall 23. The fixing portion 42 is flaky or rib-liked and has a shape matching the shape of the positioning structure 26.

As show in the figures, the guiding portion 41 is used to guide and fix the cable, and a part of the guiding portion 41 passes through the through hole 25. The cables can pass through the guiding portion 41 and extend towards the front wall 21 in the guiding portion 41.

In an embodiment, as shown in the figures, the guiding portion 41 is in the shape of a hole and the cables can pass through the hole. In an alternative implementation, the guiding portion 41 is in the shape of a slot.

As shown in the figures, the refrigeration appliance further includes a power utilization component 7 provided in the door 2, and the power utilization component 7 is disposed on an end opposite to the cable guiding member 4.

The cables can extend from the case body 1 to the door 2 along the guide rail 5. Specifically, the cables extend out of the case body 1 along the guide rail 5, and then, the cables pass through the guiding portion 41 to enter the accommodating space 24, and thus, the cables extending out of the case body 1 extend into the door 2 through the through hole 25.

In an alternative embodiment, a wiring terminal for connecting the cables is disposed in the guiding portion 41. In an embodiment, the wiring terminal is located outside the door 2 and in another alternative embodiment, the wiring terminal is also located in the door 2.

When the cables extend from the case body 1 to the guiding portion 41 along the guide rail 5, a cable is inserted or connected to one end of the wiring terminal close to the case body 1, and then, another cable extends into the guiding portion 41 from the accommodating space 24 and is inserted into or connected to the other end of the wiring terminal. Then, the cable is connected to another power utilization component 7 in the door 2.

The present invention has been described as above by using relevant embodiments. However, the embodiments are only examples for implementing the present invention. It should be noted that, the disclosed embodiments are not intended to limit the scope of the present invention. On the contrary, changes and modifications made without departing from the spirit and scope of the present invention all fall in the patent protection scope of the present invention.

LIST OF REFERENCE NUMERALS

1 Case body
2 Door
21 Front wall
22 Rear wall
23 Side wall
24 Accommodating space
25 Through hole
26 Positioning structure
27 Recess
3 Power and/or signal transmission apparatus
4 Cable guiding member
41 Guiding portion
42 Fixing portion
43 Support leg
44 Protrusion
5 Guide rail
6 Sealing portion
7 Power utilization component

The invention claimed is:

1. A refrigeration appliance, comprising:

a case body;

a door configured to be connected to said case body and to slide forwards and backwards, said door including a front wall, a rear wall spaced apart from said front wall, a side wall interconnecting said front wall and said rear wall, and an accommodating space to be filled with heat insulation material, said accommodating space being enclosed and formed by said front wall, said rear wall and said side wall;

at least one of a power or signal transmission apparatus passing through a through hole in said rear wall and including cables; and a cable guiding member located in said accommodating space and configured for guiding the cables;

wherein said cable guiding member includes a guiding portion, said guiding portion extends out of said door through said through hole; and wherein said cable guiding member includes a fixing portion for fixing said cable guiding member, said front wall or said side wall has a positioning structure matched with said fixing portion, and said fixing portion is located in said positioning structure.

2. The refrigeration appliance according to claim 1, wherein said cable guiding member is fixed on said side wall or on said front wall.

3. The refrigeration appliance according to claim 2, wherein said cable guiding member is connected to said rear wall.

4. The refrigeration appliance according to claim 2, wherein said side wall is a bottom wall.

5. The refrigeration appliance according to claim 1, wherein said cable guiding member has a guiding portion for guiding the cables extending towards said front wall within said guiding portion.

6. The refrigeration appliance according to claim 5, wherein said guiding portion is in a shape of a slot or a hole.

7. The refrigeration appliance according to claim 1, which further comprises a fixing portion fixed on said side wall, and a guiding portion aligned parallel with said fixing portion and configured for guiding the cables.

8. The refrigeration appliance according to claim 7, which further comprises a support leg connected between said guiding portion and said fixing portion, said support leg being aligned obliquely towards said rear wall.

9. The refrigeration appliance according to claim 1, wherein said cable guiding member includes a guiding portion, and said transmission apparatus includes a wiring terminal located in said guiding portion and located outside said door.

10. The refrigeration appliance according to claim 1, wherein said rear wall has a recess spaced apart from said accommodating space, and said cable guiding member is at least partially accommodated in said recess.

11. The refrigeration appliance according to claim 10, wherein said cable guiding member includes a protrusion extending upwards, said protrusion being disposed in a vicinity of said recess in a vertical direction.

12. The refrigeration appliance according to claim 1, which further comprises a guide rail for guiding the cables from said case body along said guide rail into said door, said guide rail interconnecting said case body and said door, and said door being configured to slide forwards and backwards along said guide rail.

13. The refrigeration appliance according to claim 1, which further comprises a power utilization component provided in said door, said power utilization component being disposed on an end of said door opposite to said cable guiding member.

* * * * *